US005881918A

United States Patent [19]

Eichler

[11] Patent Number: 5,881,918

[45] Date of Patent: Mar. 16, 1999

[54] MULTI-LIQUID DISPENSER

[76] Inventor: Barbara J. Eichler, 378 S. Barrington Dr., Florence, S.C. 29501

[21] Appl. No.: 816,856

[22] Filed: Mar. 13, 1997

Related U.S. Application Data

[63] Continuation-in-part of Ser. No. 63,213, Dec. 2, 1996.

[51] Int. Cl.[6] ..... B67D 5/52

[52] U.S. Cl. ..... 222/135; 222/321.9

[58] Field of Search ..... 222/94, 129, 135, 222/321.9

[56] References Cited

U.S. PATENT DOCUMENTS

| | | | |
|---|---|---|---|
| D. 351,752 | 10/1994 | Adamson . | |
| 2,465,142 | 3/1949 | Wisler . | |
| 2,529,407 | 11/1950 | Midouhas . | |
| 2,661,871 | 12/1953 | Huenergardt | 222/129 |
| 2,681,549 | 6/1954 | Maxwell . | |
| 3,269,389 | 8/1966 | Meurer et al. | 222/135 |
| 3,349,967 | 10/1967 | Schneller . | |
| 3,603,485 | 9/1971 | Vivier | 222/129 |
| 3,990,611 | 11/1976 | Sojka . | |
| 4,433,796 | 2/1984 | Brooks, Jr. | 222/135 |
| 4,548,340 | 10/1985 | Messer . | |
| 4,809,878 | 3/1989 | Rainey | 222/321.9 |
| 4,913,319 | 4/1990 | Root . | |
| 5,114,048 | 5/1992 | Minke . | |
| 5,152,430 | 10/1992 | Ruiberriz de Torres . | |
| 5,356,040 | 10/1994 | Reggiani | 222/129 |
| 5,647,510 | 7/1997 | Keller | 222/94 |

*Primary Examiner*—Joseph A. Kaufman
*Attorney, Agent, or Firm*—Michael A Mann; Nexsen Pruet Jacobs & Pollard LLP

[57] ABSTRACT

A multi-liquid dispenser comprising a housing having at least one vertical partition positioned within its interior to define separate chambers. A removable cover formed with a depending rim, abuts the interior wall of the housing, thereby forming a fluid-tight seal between the housing and the cover. The rim is formed with at least one transverse channel dimensioned to receive the vertical partition, thus creating a barrier which prevents fluid contained in one chamber from migrating to an adjacent chamber. A series of pumps are carried by the cover, with each pump being dedicated to a particular chamber.

15 Claims, 3 Drawing Sheets

72
70
71
73
74
40
75
42
21
44
22
24
20
100

72
70
71
73
74
42
21
24
22
100

MULTI-LIQUID DISPENSER

BACKGROUND OF THE INVENTION

1. Field of the Invention

The present invention relates generally to liquid dispensers. In particular, the present invention advances a dispenser for separately holding and dispensing a plurality of fluids. The present application is a continuation-in-part application of co-pending U.S. Design Patent Application Ser. No. 29/063,213 filed Dec. 2, 1996, which is now pending.

2. Discussion of Background

Liquid dispensers have long been recognized by consumers as a convenient and sanitary means of dispensing bath and skin care products, such as liquid soap, shampoo, mousse, hair styling gel, bubble bath, face and body moisturizers, and the like.

Given their attractiveness to consumers, the prior art has advanced several liquid dispenser apparatus. For example, U.S. Pat. No. 3,990,611 issued to Sojka advances a series of independent dispensing devices that are removably mounted on a rack affixed to a wall. U.S. Pat. No. 3,349,967 issued to Schneller advances a wall mounted toiletry dispenser device which holds a series of independent dispensing containers. The device has a rotatable front panel enabling access to the dispensing containers.

U.S. Pat. No. 5,152,430 issued to Ruiberriz de Torres sets forth a wall dispenser for a series of independent dispensing units. The middle dispensing units are smaller than the end units to allow the placement of a shelf to support grooming accessories.

U.S. Pat. No. 4,548,340 issued to Messer teaches a pair of liquid dispensers positioned within a housing. The housing is designed to be mounted within the interior of a wall and includes a face plate which is flush with the face of the wall when the device is mounted.

U.S. Pat. No. 4,913,319 issued to Root provides a device to be mounted on a wall which comprises at least two independent liquid chambers, each of which has a dedicated pump dispenser. The front face of the device also carries a mesh material releasibly secured to a retractable cable. The cable allows the bar of soap to be moved a distance from the device and then returned to its original position.

A major problem confronting the present state of the art is the inability of liquid dispensers to be easily transported. Many travelers, especially business travelers, wanting to take a variety of bath or skin care products are forced to transport separate dispensers for lack of a more suitable alternative. Transporting separate liquid containers unnecessarily increases the weight of one's luggage, and more importantly, consumes valuable luggage space.

Therefore, there exists a need for a multi-liquid dispenser capable of separately storing and dispensing a variety of skin and bath care liquids.

SUMMARY OF THE INVENTION

According to its major aspects and broadly stated, the present invention is a multi-liquid dispensing device for use in separately storing and dispensing a plurality of skin or bath care products such as liquid soap, shampoo, mousse, hair styling gel, bubble bath, face and body moisturizers, and the like. Hereinafter, such bath and skin care products will be collectively referred to as "liquids." The dispenser comprises a housing and a removable cover. The housing contains one or more vertical partitions which segment the interior of the housing into separate chambers. A rim depending from the bottom of the cover is dimensioned to fit flush against the interior surface of the housing wall. The rim depends from the cover by a preselected distance within the interior of the housing and is formed with one or more transverse channels in mating registration with the partitions. The top of the cover is formed with at least two apertures through which dispensing pumps are placed into the separated chambers. The external surface of the housing may contain an ornamental design, while the external surface of the cover may have affixed thereto labels describing the types of fluids contained within the separate containers.

A major feature of the present invention is the vertical partitions located within the interior of the housing. These partitions divide the interior of the housing to thereby permit the introduction of more than one type of liquid into a single housing.

Another major feature of the present invention is the rim in combination with both the transverse channels and vertical partitions. The rim, by depending a preselected distance within the interior of the housing, provides an effective barrier to prevent fluids from escaping from the housing interior. In addition, the rim provides a tight seal which prevents the inadvertent removal of the cover from the housing. Moreover, the partition and transverse channel in registration therewith prohibit the migration of fluid from one chamber to another. This combination ensures that the fluids remain in the chamber in which they are placed, and thus enables the dispenser to placed in luggage and transported without fear that the fluid contents will mix or escape from the housing.

Still another feature of the present invention is the combination of a one-piece housing and a one-piece cover. The cover and housing form a compact, transportable dispenser suited for a variety of applications, such as beauty shops, nurseries, hospitals, and travel homes, which normally require the use of more than one type of fluid. Furthermore, the dispenser is ideally suited for travelers who require a compact dispenser capable of holding more than one fluid.

Other features and advantages will be apparent to those skilled in the art from a careful reading of the Detailed Description of a Preferred Embodiment accompanied by the following drawings.

DETAILED DESCRIPTION OF A PREFERRED EMBODIMENT

Figure 1:
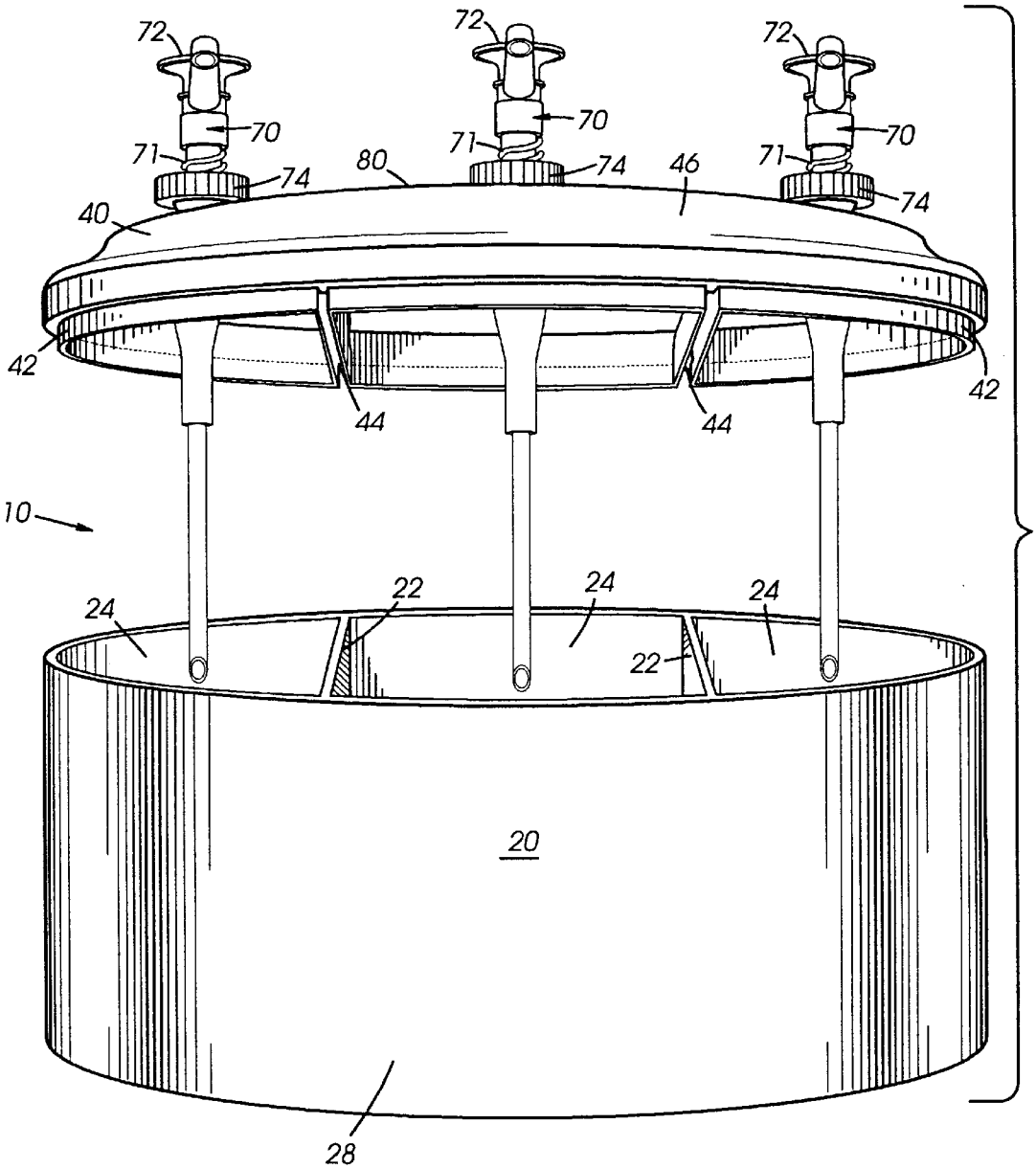
FIG. 1 is an exploded view of a liquid dispenser according to a preferred embodiment of the present invention.
Figure 2:
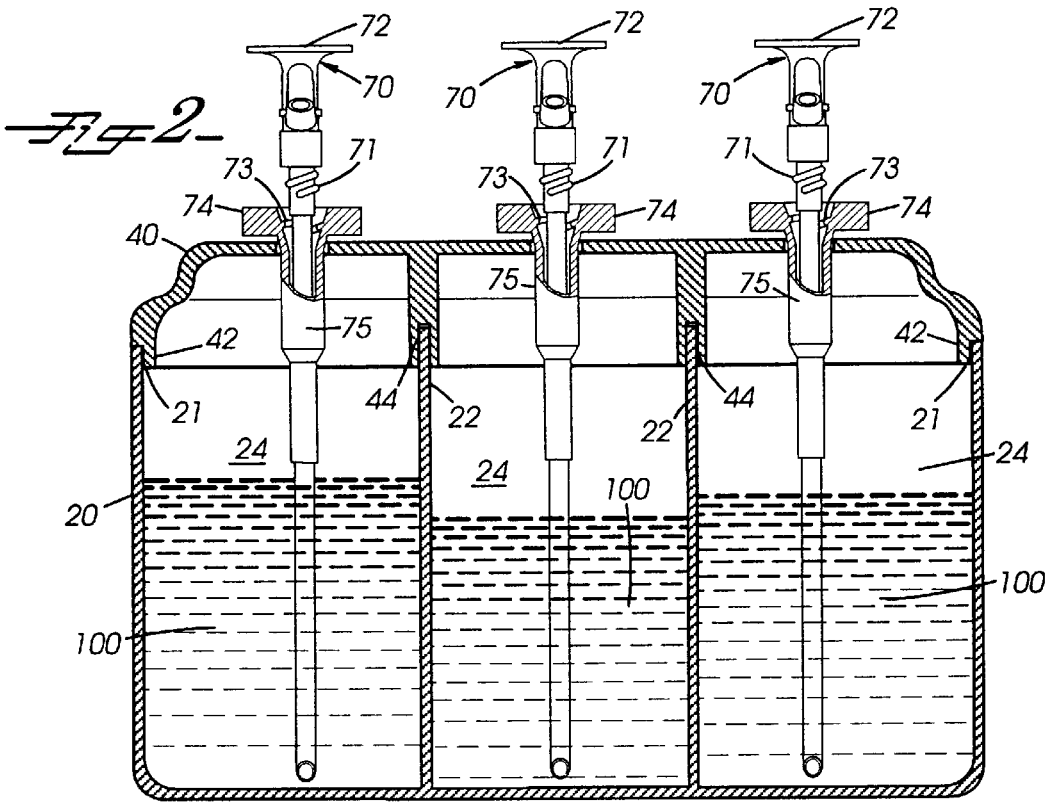
FIG. 2 is a cross-sectional view of a liquid dispenser according to a preferred embodiment of the present invention.

The present invention is a liquid dispenser which holds and dispenses at least two separate fluids. Referring now to FIGS. 1 and 2, there is shown an exploded view and a cross-sectional view of a liquid dispenser according to a preferred embodiment of the present invention and generally designated by reference numeral 10. Dispenser 10 comprises a housing 20 and a cover 40 and two or more pumps 70. Housing 20 and cover 40 may be made of any durable and washable material commonly used in the art, including but not limited to, composites, alloys or glazed ceramics. Preferably, housing 20 and cover 40 are made of a polymeric material. As illustrated, both housing 20 and cover 40 are shown as having an elliptical shape; however, it will be recognized by those with ordinary skill in the art that housing 20 and cover 40 may be any shape without departing from the spirit and scope of the present invention.

Housing 20 is formed with one or more vertical partitions 22 that define chambers 24 which receive fluids 100. Depending from cover 40 is a rim 42. Rim 42 abuts interior wall 21 and depends a preselected distance within the interior of housing 20 to thereby form a fluid-tight seal between cover 40 and housing 20. Positioned transversely along rim 42 are one or more channels 44. Channels 44 are dimensioned to receive partitions 22 when cover 40 is placed over housing 20. As can be seen in FIG. 2, the placement of partitions 22 within channels 44 serves to confine liquids 100 within a particular chamber 24 and to prevent their migration to an adjacent chamber 24.

Pumps 70 are removably placed into chambers 24 via apertures 75 formed in top 80 of cover 40. Pumps 70 may be any manual or electric dispensing pump commonly employed in the art. Preferably, pumps 70 each have an external thread 71. When head 72 of pump 70 is pushed downward toward cover 40 and subsequently axially rotated, thread 71 engages grooves 73 formed in housing 74 of pump 70, thereby locking head 72 in position and preventing the expulsion of fluids from pumps 70. It will be recognized by those with ordinary skill in the art that other locking means may be substituted for thread 71 and grooves 73 without departing from the spirit and scope of the present invention.

Exterior surface 28 of housing 20 may be formed with a decorative design to enhance the ornamentality of dispenser 10. The design may be etched into, painted on, or adhesively attached to exterior surface 28. Cover 40 may contain removable labels adhesively attached to outer surface 46 which indicate to the user the type of liquids 100 residing within chambers 24.

Figure 4:
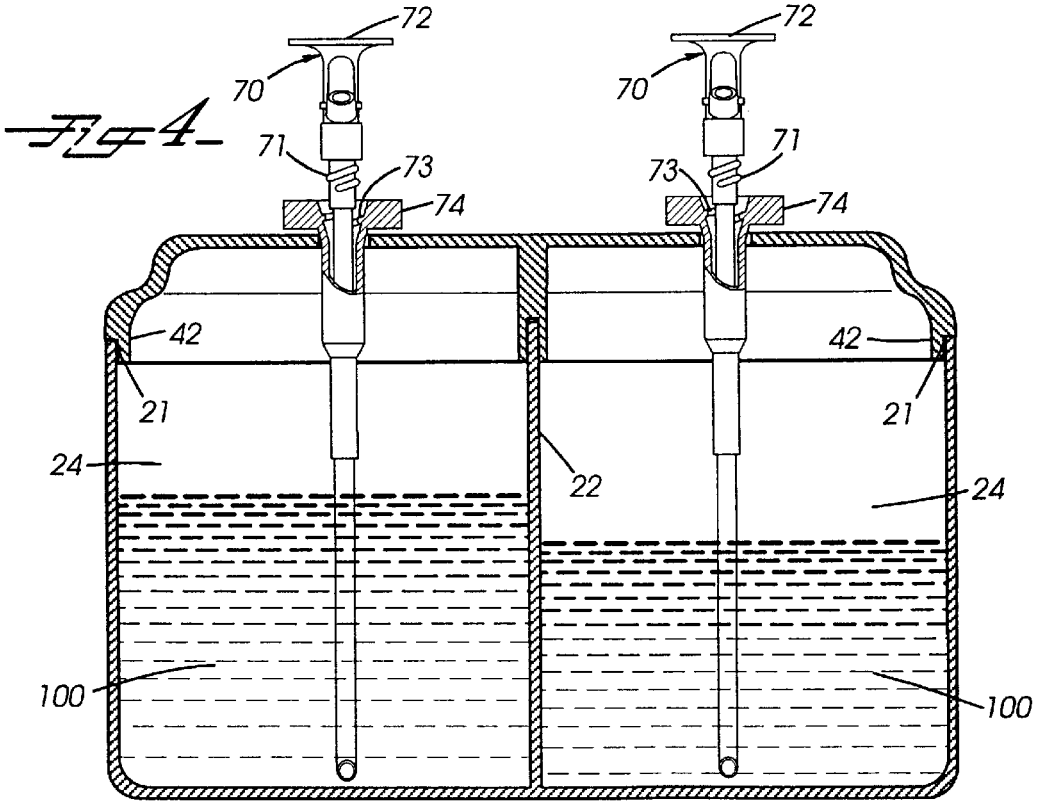
FIG. 4 is a cross-sectional view of a liquid dispenser according to an alternative preferred embodiment of the present invention.
Figure 3:
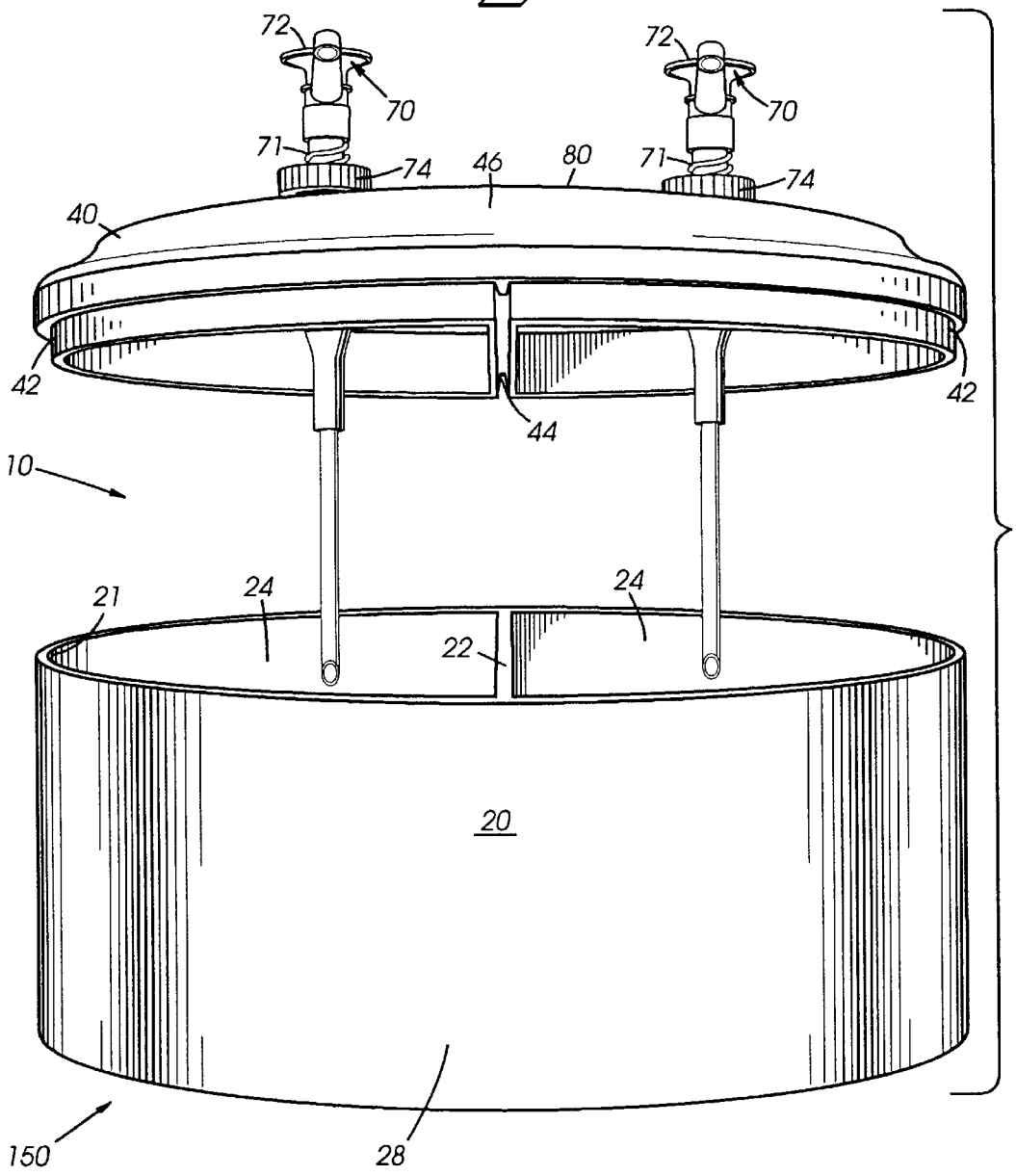
FIG. 3 is an exploded view of a liquid dispenser according to an alternative preferred embodiment of the present invention.

Turning now to FIGS. 3 and 4, there is shown an exploded view and a cross-sectional view of a liquid dispenser according to an alternative preferred embodiment and generally indicated by reference numeral 150. Dispenser 150 is illustrated as having a single partition 22 and a single channel 44, in contrast to the two channels 44 and two partitions 22 shown in FIGS. 1 and 2.

It will be apparent to those skilled in the art that many modifications and substitutions can be made to the preferred embodiments just described without departing from the spirit and scope of the invention as defined in the appended claims.

What is claimed is:

1. A liquid dispenser comprising:

a housing having an interior and an interior wall;

a cover removably card by said housing;

means carried by said cover for forming a fluid-tight seal between said cover and said housing;

means for defining a plurality of chambers within said interior of said housing, said cover covering said plurality of chambers; and a plurality of pumps carried by said cover, each pump of said plurality of pumps in fluid communication with a chamber of said plurality of chambers for dispensing fluid from said chamber separately from fluid in other chambers of said plurality of chambers.

2. The dispenser as recited in claim 1, wherein said forming means further comprises a rim depending from said cover, said rim dimensioned to abut said interior wall of said housing.

3. The dispenser as recited in claim 1, wherein said forming means further comprises a rim depending from said cover, said rim dimensioned to abut said interior wall of said housing, and wherein said rim is formed with at least one transverse channel dimensioned to receive said defining means.

4. The dispenser as recited in claim 1, wherein said defining means is a vertical partition formed in said interior of said housing.

5. The dispenser as recited in claim 1, wherein said defining means are two vertical partitions formed in said interior of said housing.

6. The dispenser as recited in claim 1, wherein said cover is made of a polymeric material.

7. The dispenser as recited in claim 1, wherein said housing is made of a polymeric material.

8. A liquid dispenser comprising:

a polymeric housing having an interior and an interior wail;

a polymeric cover removably carried by said housing;

at least one vertical partition formed in said interior of said housing;

means carried by said cover for forming a fluid-tight seal between said cover and said housing; and a plurality of pumps carried by said cover, each pump of said plurality of pumps in fluid communication with a chamber of said plurality of chambers said plurality of chambers for dispensing fluid from said chamber separately from fluid in other chambers of said plurality of chambers.

9. The dispenser as recited in claim 8, wherein said forming means further comprises a rim depending from said cover, said rim dimensioned to abut said interior wall of said housing.

10. The dispenser as recited in claim 8, wherein said forming means further comprises a rim depending from said cover, said rim dimensioned to abut said interior wall of said housing, and wherein said rim is formed with at least one transverse channel dimensioned to receive said at least one partition.

11. The dispenser as recited in claim 8, wherein said at least one partition is two partitions.

12. A liquid dispenser comprising:

a housing having an interior and an interior wall;

a cover removably carried by said housing;

at least one vertical partition formed in said interior of said housing, said at least one vertical partition defining a plurality of chambers;

a rim depending from said cover, said rim dimensioned to abut said interior wall of said housing, said rim being formed with at least one transverse channel dimensioned to receive said at least one partition; and a plurality of pumps carried by said cover, each pump of said plurality of pumps in fluid communication with a chamber of said plurality of chambers said plurality of chambers for dispensing fluid from said chamber separately from fluid in other chambers of said plurality of chambers.

13. The dispenser as recited in claim 12, wherein said at least one vertical partition is two vertical partitions.

14. The dispenser as recited in claim 12, wherein said cover is made of a polymeric material.

15. The dispenser as recited in claim 12, wherein said housing is made of a polymeric material.

* * * * *